US009331408B2

(12) United States Patent
Ono

(10) Patent No.: US 9,331,408 B2
(45) Date of Patent: May 3, 2016

(54) ELECTRICAL CONNECTOR ASSEMBLED COMPONENT

(71) Applicant: Hirose Electric Co., Ltd., Tokyo (JP)

(72) Inventor: Shozo Ono, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 14/686,832

(22) Filed: Apr. 15, 2015

(65) Prior Publication Data

US 2015/0303593 A1 Oct. 22, 2015

(30) Foreign Application Priority Data

Apr. 17, 2014 (JP) ..... 2014-085477

(51) Int. Cl.

| | |
|---|---|
| ***H01R 11/22*** | (2006.01) |
| ***H01R 12/72*** | (2011.01) |
| ***H01R 12/75*** | (2011.01) |
| ***H01R 13/05*** | (2006.01) |
| ***H01R 13/11*** | (2006.01) |
| ***H01R 13/20*** | (2006.01) |
| *H01R 4/18* | (2006.01) |
| *H01R 101/00* | (2006.01) |

(52) U.S. Cl.

CPC ..... *H01R 12/728* (2013.01); *H01R 12/75* (2013.01); *H01R 13/055* (2013.01); *H01R 13/113* (2013.01); *H01R 13/20* (2013.01); *H01R 4/184* (2013.01); *H01R 2101/00* (2013.01)

(58) Field of Classification Search

CPC ..... H01R 4/48; H01R 12/57; H01R 12/75; H01R 12/728; H01R 13/055; H01R 13/18; H01R 13/114; H01R 13/113; H01R 13/115; H01R 13/20

USPC ..... 439/81, 83, 825, 848–852, 854

See application file for complete search history.

(56) References Cited

U.S. PATENT DOCUMENTS

| | | | | |
|---|---|---|---|---|
| 3,546,663 | A * | 12/1970 | Centre, Jr. | H01R 3/20 439/849 |
| 3,644,872 | A * | 2/1972 | Russo, Jr. | H01R 13/115 439/849 |
| 4,550,963 | A * | 11/1985 | Moors | H01R 13/115 439/170 |
| 4,552,425 | A * | 11/1985 | Billman | H01R 13/28 439/295 |
| 6,544,079 | B2 * | 4/2003 | Renkes | H01R 13/20 439/848 |
| 7,497,715 | B2 * | 3/2009 | Wu | H01R 9/091 439/329 |
| 9,039,429 | B2 * | 5/2015 | Shimoji | H01R 12/728 439/81 |

FOREIGN PATENT DOCUMENTS

JP 4885320 B 12/2011

* cited by examiner

*Primary Examiner* — Neil Abrams
*Assistant Examiner* — Travis Chambers
(74) *Attorney, Agent, or Firm* — Kubotera & Associates, LLC

(57) ABSTRACT

An electrical connector assembled component includes a first connector to be disposed on a circuit board and including a receiving portion; and a second connected to be accommodated in the receiving portion. The receiving portion includes a cylindrical receiving portion and an open receiving portion. The open receiving portion includes a locking piece connected to the side plate portion. The locking piece includes a locking portion at a front edge thereof. The cylindrical receiving portion includes an elastic contact piece. The second connector includes an elastic locking arm extending from the flat plate portion. The elastic locking arm is situated inside the cylindrical receiving portion at a position different from that of the elastic contact piece in the width direction, and at a position overlapped with that of the elastic contact piece in a vertical direction.

11 Claims, 7 Drawing Sheets

ELECTRICAL CONNECTOR ASSEMBLED COMPONENT

BACKGROUND OF THE INVENTION AND RELATED ART STATEMENT

The present invention relates to an electrical connector assembled component composed of a first connector to be disposed on a substrate and a second connector to be received in and connected to the first connector. In particular, the present invention relates to an electrical connector assembled component, in which the first connector and the second connector that compose the connector assembled component are made by bending a sheet metal.

As a conventional electrical connector assembled component of this type, Patent Reference discloses a receptacle connector to connect to a circuit board as a first connector and a plug connector as a second connector.

Patent Reference: Japanese Patent No. 4,885,320

According to Patent Reference, both of the receptacle connector and the plug connector are made by bending a sheet metal. The receptacle connector mounted on a circuit board has a laterally laid rectangular cylindrical accommodating section. The receptacle connector is to be connected by soldering to a circuit board at a bottom plate of the accommodating section. The accommodating section includes a contact spring strip that is made by cutting and lifting a part of the bottom plate thereof and elastically contacts with the plug connector upon insertion of the plug. On a top plate of the accommodating section, there is formed a window-like locking portion, so as to lock a locking strip of the plug. On the other hand, in the plug connector, an insertion section to be inserted forward into the rectangular cylindrical accommodating section of the receptacle connector has side plates that are formed by bending up both sides of the bottom plate, and has a lock spring strip that is formed by bending the front end of the bottom plate backward so as to be provided above the bottom plate. The lock spring strip is formed so as to have a rear end to slightly be lifted. The plug connector is connected to a cable at a rear end side thereof.

When the plug connector is inserted in the accommodating section of the receptacle connector, the bottom plate of the plug connector presses the elastic contact strip of the receptacle downward so as to elastically contact with the elastic contact strip. An edge of the rear end section of the lock spring strip of the plug connector enters in the window-like locking portion and is brought to a position so as to be able to lock at the rear end of the inner circumferential edges of the locking portion. Once the plug connector is pulled backward, the lock spring strip and the locking portion engage with each other and are locked in the pull-out direction.

According to Patent Reference, the whole receptacle connector and plug connector are made by bending work of a sheet metal. Further, the accommodating section and the elastic contact strip of the receptacle connector are integrally made as one piece, and the bottom plate, the side plates, and the lock spring strip of the plug connector are integrally made as one piece. Here, according to Patent Reference, since the receptacle connector and the plug contact connector to each other directly, the receptacle connector and the plug contact connector are also referred to as terminals.

According to Patent Reference, in a state of use, in which the plug connector is fitted and connected to the receptacle connector, the four members, i.e., the elastic contact strip of the receptacle connector, the bottom plate of the plug connector, the lock spring strip of the plug connector, and the top plate of the receptacle connector, are provided so as to pile up in the order, upward from a position of the circuit board.

Therefore, in case of the conventional connector assembled component disclosed in Patent Reference, when it is in use, a height dimension on a circuit board will be at least the total of height dimensions of the four members.

The conventional connector assembled component of this type to be mounted on a circuit board is strongly demanded to have a small height dimension in view of design of electronic devices for mounting a circuit board, to which the conventional connector assembled component is connected.

In view of the problems described above, an object of the present invention is to provide an electrical connector assembled component that can have even smaller height dimension than the conventional connector assembled component of Patent Reference.

Further objects and advantages of the present invention will be apparent from the following description of the present invention.

SUMMARY OF THE PRESENT INVENTION

In order to attain the objects described above, according to a first aspect of the present invention, an electrical connector assembled component includes a first connector to be disposed on a substrate, and a second connector to be inserted forward so as to be received in a receiving portion of the first connector.

According to the first aspect of the present invention, the first connector and the second connector are configured as follows:

The first connector is formed by bending a sheet metal. The receiving portion includes a cylindrical receiving portion and an open receiving portion. The cylindrical receiving portion is composed of a bottom plate that contacts by surface with a substrate surface, side plates that rise from both side edges of the bottom plate, and a top plate that connects upper ends of the side plates at front region in the connector width direction. The open receiving portion is formed in the rear region by the bottom plate and the side plates so as to be open upward. The open receiving portion has locking pieces that are connected to upper ends of the side plates. Front edges of the locking pieces form a locking portion. The cylindrical receiving portion has an elastic contact piece that extends from the top plate or the bottom plate and extends frontward or backward in the cylindrical receiving portion.

The second connector is formed by bending sheet metal. The second connector has a flat section that spread in the connector width direction and extends in a front-and-back direction. The second connector further includes a contacted portion that is formed on the flat section so as to contact with the elastic contact piece of the first connector from thereabove or thereunder, and elastic locking arms that extends backward from the flat section via bent sections. Each elastic locking arm has a locked portion that engages with the locking portion of the first connector in the open receiving portion. When the second connector is pulled backward, the sections to be locked and the locking portions engage each other, and restrict the second connector from being pulled out. The elastic contact piece of the first connector and the elastic locking arms of the second connector are configured so as to be brought to different positions in the connector width direction and to have overlapping area in the up-and-down direction within the cylindrical receiving portion.

According to the first aspect of the present invention, once the first connector and the second connector are connected to each other, within the range of the cylindrical receiving portion (front region) of the first connector, the elastic contact section of the first connector and the elastic locking arms of the second connector are brought to the positions that are different in the connector width direction but have overlapping area in the up-and-down direction. Therefore, for the dimension of the overlapping area, the electrical connector assembled component can have a smaller size in the height direction in comparison with the conventional one. Here, according to the present invention, the locking piece of the first connector is not limited to the one in this embodiment, in which the locking piece is directly connected to the upper ends of the side plates, and can be indirectly joined thereto.

According to a second aspect of the present invention, the locking portions of the first connector and the sections to be locked of the second connector are preferably provided such that flat surfaces thereof cross each other when viewed in the front-and-back direction, in a locked state. When the flat surfaces of the locking portion and the locked portion cross each other in the open receiving portion (rear region) outside the cylindrical receiving portion, the locking portion and the locked portion contact with each other at their end surfaces, i.e., flat surfaces. Therefore, it is achievable to secure the locking engagement and to enhance the strength of the both sections against the abutting force.

According to a third aspect of the present invention, the locking pieces of the first connector face each other in the connector width direction, and form a pair of locking pieces that is bent towards the bottom plate. A front edge of each locking piece can form a locking portion. In this case, the locking pieces of the first connector extend towards the bottom plate. Therefore, the sections to be locked of the second connector may be embodied to have flat surfaces that are horizontal to the bottom plate of the first connector. As a result, the second connector will not have a large dimension in the height direction. On the other hand, in case of the first connector, the locking pieces are located in the open receiving portion, so that there is originally enough space to allow their bending towards the bottom plate. Therefore, the first connector will also have a large dimension in the height direction from bending towards the bottom plate.

According to a fourth aspect of the present invention, each locking piece of the first connector preferably has a inclined guide section so as to allow the second connector to move forward by pressing to elastically deform the elastic locking arms of the second connector in the process of receiving the second connector in the receiving portion. With this configuration, the elastic locking arms of the second connector are pressed by the inclined guide surfaces of the locking pieces of the first connector so as to be elastically deformed and guided. As a result, it is achievable to easily move the second connector forward towards the receiving portion of the first connector.

According to a fifth aspect of the present invention, the locking portions of the first connector may be tilted such that the abutting force in the locked state between the locking portions and the sections to be locked generate an upward component of force that displaces the sections to be locked upward. With this configuration, when the second connector is pulled in a pull-out direction, the sections to be locked displace upward along the inclination of the locking portions, i.e., in a direction towards basal sections of the bending of the locking portions. Therefore, the sections to be locked move away from the free ends, where the locking is easily released, and the locking can be deep and will not be released.

According to a sixth aspect of the present invention, the second connector has a positioning section that abuts a rear edge of the cylindrical receiving portion in order to set the receiving depth for receiving the first connector in the cylindrical receiving portion at a set position. A front part of the second connector is to be inserted in the cylindrical receiving portion of the first connector. Therefore, it is difficult to visually see the front edge that is hidden in the cylindrical receiving portion, and it is impossible to check the insertion amount. Under this situation, providing the positioning section on the second connector, the positioning section will abut the rear edge of the cylindrical receiving portion of the first connector. As a result, there will be no excess insertion and the insertion position will be set by itself. In addition, it is also possible to feel that the insertion reaches the set point by the abutting.

According to a seventh aspect of the present invention, the second connector preferably has lower restricting sections that restrict excess downward elastic displacement of the elastic locking arms, which exceeds set amount. With this configuration, the elastic locking arms are inhibited from excess elastic displacement, which exceeds the amount required for elastic displacement to insert the second connector into the first connector, and excess stress will not be generated on the elastic locking arms.

According to an eighth aspect of the present invention, the first connector preferably has upper restricting sections, which restrict upward elastic displacement of the elastic locking arms of the second connector, in the rear region. With this configuration, in a state that the second connector is connected to the first connector, when the second connector is handled in an unexpected manner, the elastic locking arms will not be elastically displaced upward, which is towards an opposite side to the normal elastic downward displacement, and thereby it is possible to protect the elastic locking arms from damaging.

According to a ninth aspect of the present invention, the second connector is preferably formed asymmetrically in the up-and-down direction when viewed in the front-and-back direction. In addition, the first connector preferably has a stopper section for preventing fitting of the second connector in a wrong manner, in which the second connector is received in the cylindrical receiving portion of the first connector in an upside down position, i.e., opposite to the normal position in the up-and-down direction.

According to a tenth aspect of the present invention, the stopper section is formed as a stopper leg that is bent at a rear edge of the upper plate of the cylindrical receiving portion and then perpendicularly extends downward. A lower end of the stopper leg is preferably provided lower than the rear end of the elastic contact section. With this configuration, the stopper leg as a stopper section prevents wrong fitting, in which the second connector is oriented up-side down. In addition, even in the process of normal fitting, according to the present invention, the stopper leg is located behind the elastic contact piece and the lower end of the stopper leg is located lower than the rear end, which is a free end, of the elastic contact piece. Therefore, the second connector to be inserted will not contact with the rear end of the elastic contact piece of the first connector, and it is possible to prevent damaging of the elastic contact piece, such as buckling.

According to an eleventh aspect of the present invention, the elastic locking arms of the second connector can be provided at two locations that are away from each other in the connector width direction and formed as a pair of elastic locking arms. The elastic locking arms are joined to each other at their rear ends, which are free ends, such that the elastic contact piece of the first connector can enter between the elastic locking arms towards the rear side. With this configuration, it is achievable to enhance the strength by joining the elastic locking arms, while the elastic locking arms have small arm widths and thereby can easily elastically displace. Furthermore, it is possible to secure space to allow the entry of the elastic contact piece of the first connector from the front side to the rear side.

According to the present invention, there is provided an electrical connector assembled component composed of a first connector and a second connector, which are both formed by bending sheet metal. The first connector is to be disposed on a circuit board, and the second connector is to be received in a receiving portion of the first connector from a front side of the second connector. An elastic contact piece of the first connector and elastic locking arms of the second connector are configured to be provided at different positions from each other in a connector width direction but to have overlapping areas in an up-and-down direction when the second connector is fitted to a cylindrical receiving portion of the first connector. Therefore, an electrical connector assembled component can have a small height dimension for an amount of the dimension equivalent to the overlapped area. As a result, it is achievable to obtain a low-profiled electrical connector assembled component.

BRIEF DESCRIPTION OF THE DRAWINGS

FIGS. 5(A) through 5(C) are views showing the electrical connector assembled component of FIG. 3 in the process of fitting and connecting the connectors according to the embodiment of the present invention, wherein FIG. 5(A) is a top view of the electrical connector assembled component, FIG. 5(B) is a sectional view of the electrical connector assembled component taken along a line VB-VB in FIG. 5(A), and FIG. 5(C) is a sectional view of the electrical connector assembled component taken along a line VC-VC in FIG. 5(A);

FIGS. 6(A) through 6(C) are views showing the electrical connector assembled component after fitting and connecting the connectors according to the embodiment of the present invention, wherein FIG. 6(A) is a top view of the electrical connector assembled component, FIG. 6(B) is a sectional view of the electrical connector assembled component taken along a line VIB-VIB in FIG. 6(A), and FIG. 6(C) is a sectional view of the electrical connector assembled component taken along a line VIC-VIC in FIG. 6(A)

DETAILED DESCRIPTION OF THE PREFERRED EMBODIMENTS

Hereunder, embodiments of the present invention will be described with reference to the accompanying drawings.

According to an embodiment, as shown in FIGS. 1 through 4, an electrical connector assembled component 1 (hereinafter simply referred to as "connector assembled component 1") includes a first connector 10 and a second connector 40. The first connector 10 is formed as a receptacle connector, and the second connector 40 is formed as a plug connector.

Figure 1:
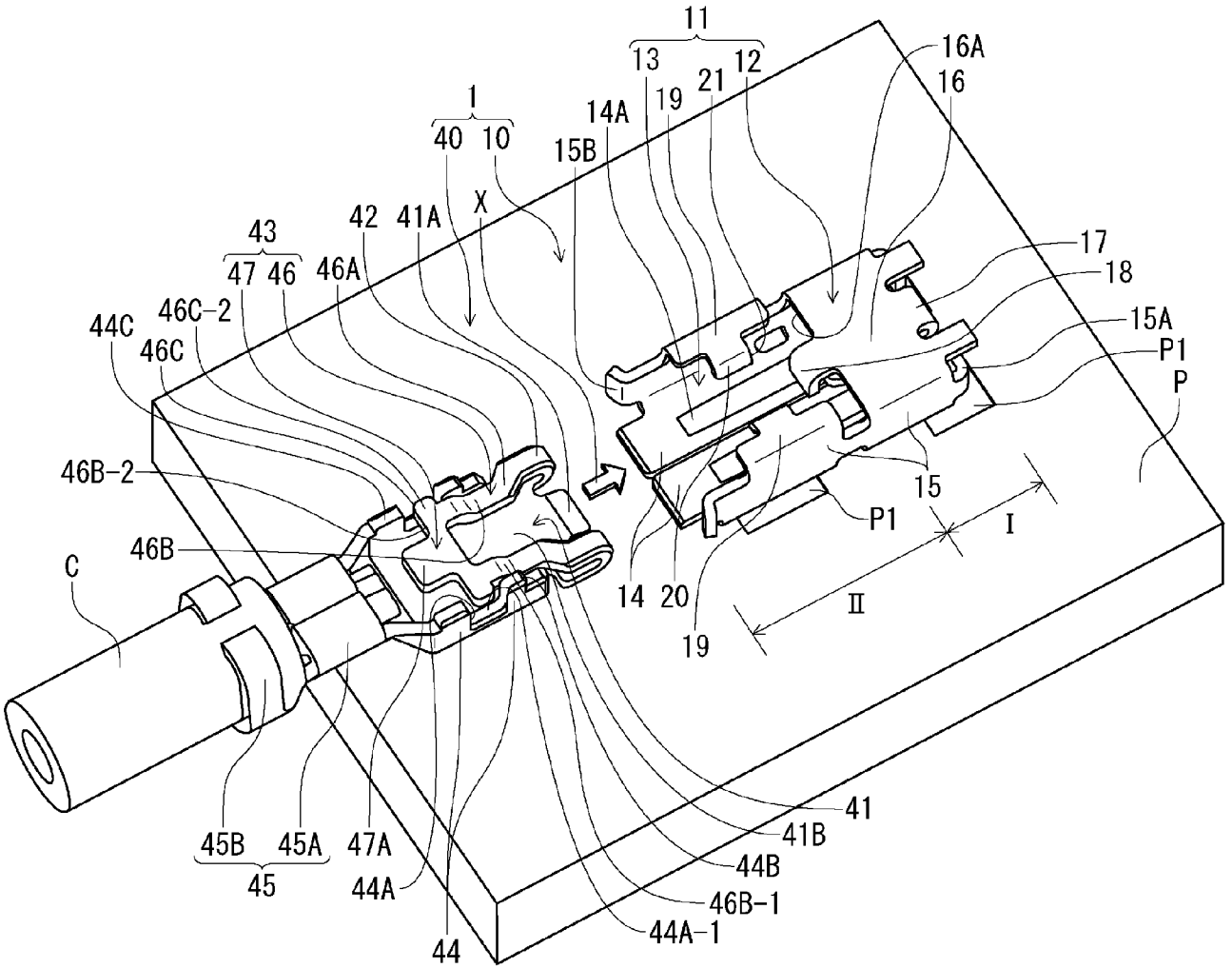
FIGS. 1 is a perspective view showing an electrical connector assembled component before fitting and connecting connectors according to an embodiment of the present invention.
Figure 2:
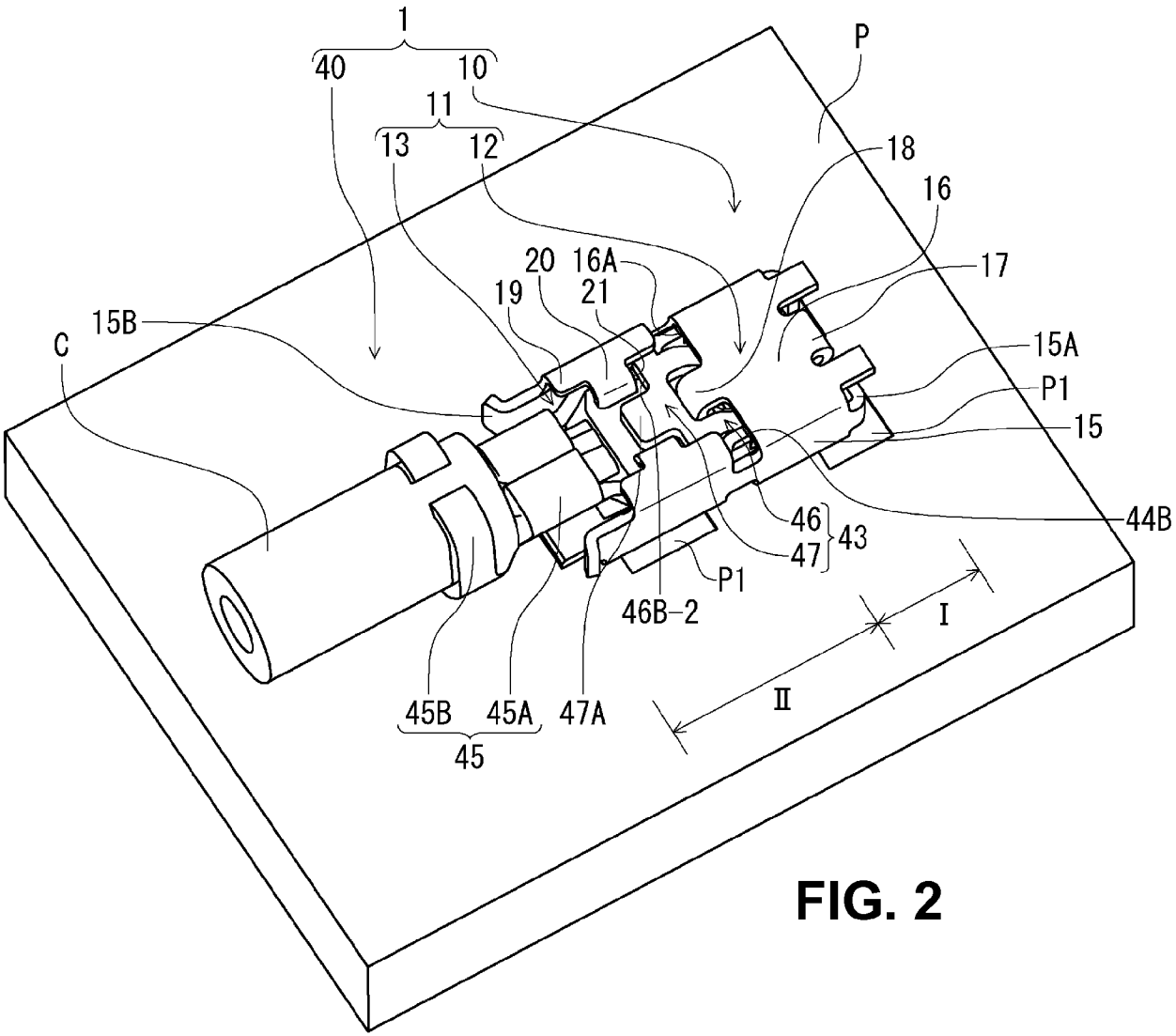
FIG. 2 is a perspective view showing the electrical connector assembled component of FIG. 1 after fitting and connecting the connectors according to the embodiment of the present invention.
Figure 3:
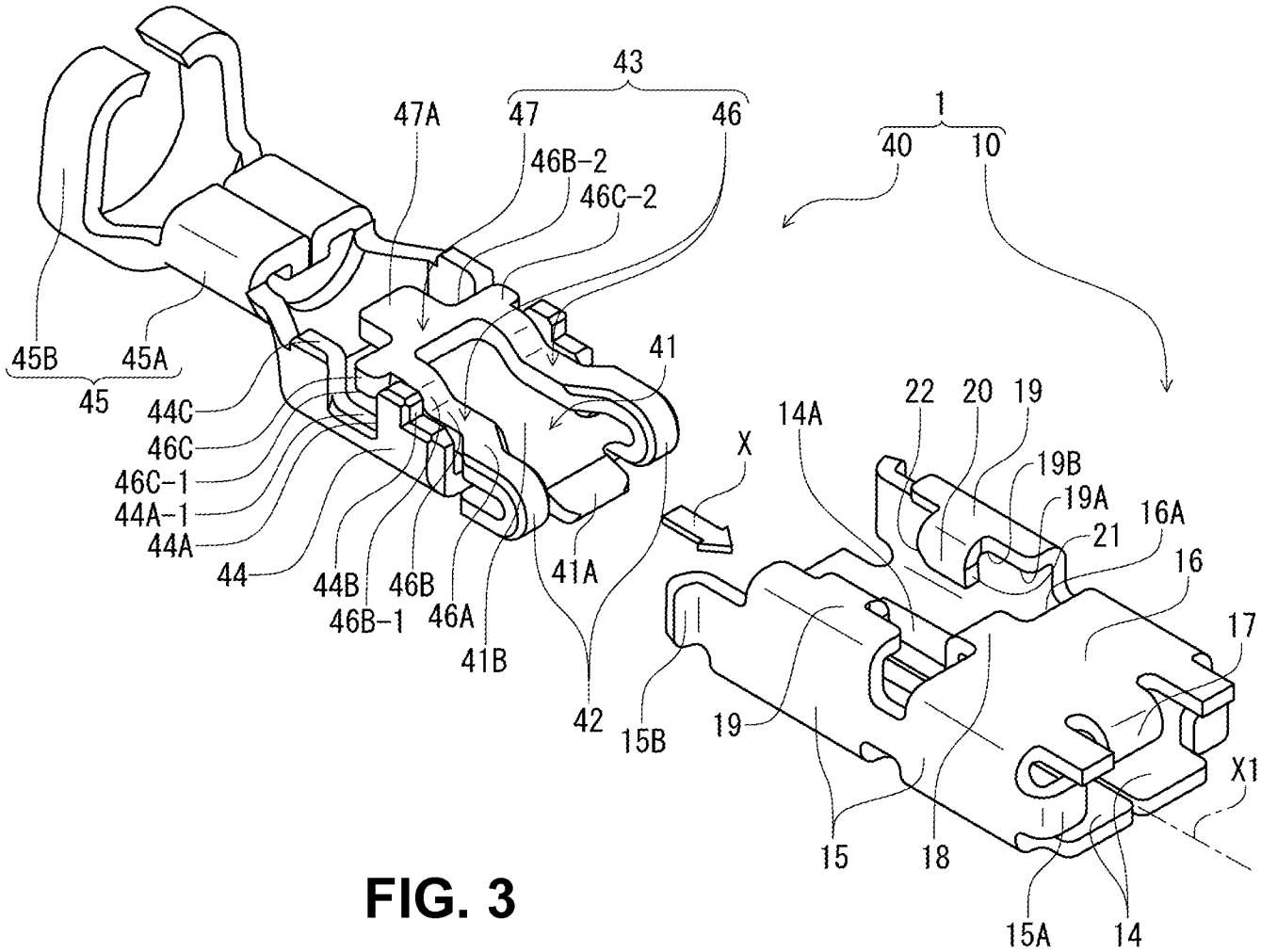
FIG. 3 is a perspective view showing the electrical connector assembled component before fitting and connecting the connectors, which is viewed from thereabove at a front side according to the embodiment of the present invention.
Figure 4:
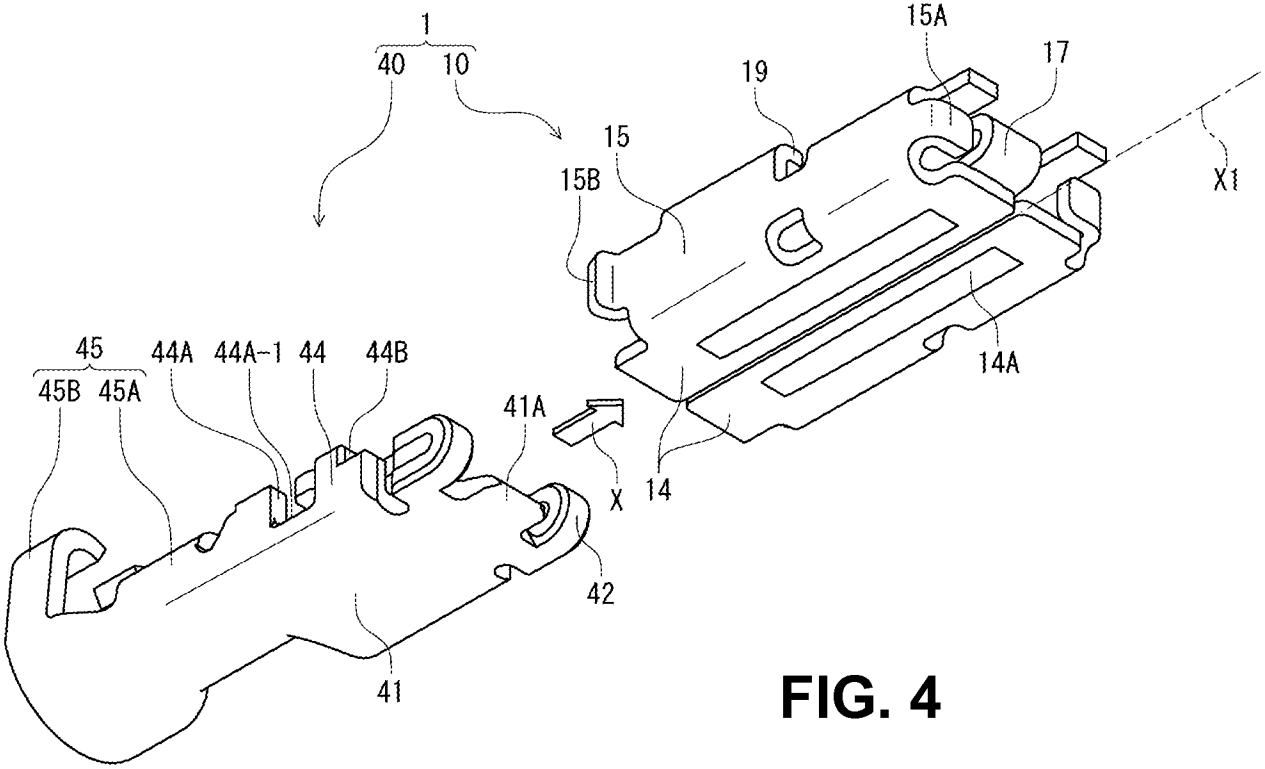
FIG. 4 is a perspective view of the electrical connector assembled component of FIG. 3, which is viewed from thereunder at the front side according to the embodiment of the present invention.

As shown in FIG. 1, the first connector 10 is mounted on a circuit board P. The second connector 40 is fitted to connect to the first connector 10, while being connected to a cable C. FIG. 1 shows the first connector 10 attached to the circuit board P and the second connector 40 before fitting to connect to the first connector 10. FIG. 2 shows the both connectors 10 and 40 in a state after they are fitted and connected. FIGS. 3 and 4 show the both connectors 10 and 40 before fitting to connect them, in which FIG. 3 is the view from thereabove and FIG. 4 is the view from thereunder. Here, in FIGS. 3 and 4, illustration of the circuit board P is omitted.

The first connector 10 and the second connector 40 are both made by bending work of sheet metal. Therefore, any part of the connectors 10 and 40 is made of metal. The first connector 10 includes a receiving portion 11 for receiving the second connector 40, which is provided on a front side (a right-hand side in FIG. 1) being directed as indicated with an arrow X. The receiving portion 11 is composed of a cylindrical receiving portion 11 provided in a front region I and an open receiving portion 13 provided in a rear region II. The first connector 10 is to be connected onto a pad P1 formed on a surface of a circuit board P by soldering bottom plates 14, which will be described later, to the pad P1.

As shown in FIGS. 3 and 4, the first connector 10 has bottom plates 14 that face each other in a connector width direction along a facing line X1 that extends in a front-and-back direction, which is perpendicular to the connector width direction. From the bottom plates 14, side plates 15 are formed by bending upward side edges of the bottom plates 14 in the connector width direction so as to rise therefrom. The side plates 15 extend in a front-and-back direction. In the front region I, the both side plates 15 are connected at their upper ends via a top plate 16. In the front region I, a rectangular cylindrical receiving portion 12 is composed of the bottom plates 14, the side plates 15, and the top plate 16, so as to be open in the front-and-back direction.

As well shown in FIG. 4, each bottom plate 14 of the cylindrical receiving portion 12 has a recess 14A formed by embossing from a lower surface in each region that partially forms the rectangular shape on the both sides of the facing line X1. The bottom plate 14 is connected to the pad P1 of the circuit board P by soldering a lower surface around the recesses 14A thereto. The side plates 15 of the cylindrical receiving portion 12 have their front ends bent inward in the connector width direction, and form front reinforcing sections 15A to keep the cylindrical shape of the cylindrical receiving portion 12.

At the rear ends of the side plates 15, introductory guide sections 15B are formed to guide the second connector 40 in the connector width direction. The introductory guide sections 15B are inclined outward in the connector width direction to be widened so as to make it easy to introduce the second connector 40 upon receiving.

The top plate 16 of the cylindrical receiving portion 12 includes an elastic contact piece 17. The elastic contact piece 17 extends from a center part of a frond edge of the top plate 16 in the connector width direction, is bent downward and further extends backward. The elastic contact piece 17 extends backward up to near a stopper leg 18, which will be described later (see FIGS. 5(B) and 5(C)). The elastic contact piece 17 has elasticity in the up-and-down direction. In addition, the elastic contact piece 17 has a V-shaped convex section provided at a position near the rear end, so as to protrude downward. The convex section has an elastic contact section 17A to contact with a contacted portion 41B of the second connector 40, which will be described later. The elastic contact section 17A is formed as a protruding section that protrudes downward by local embossing (see FIGS. 5(B) and 5(C)).

In addition, the top plate 16 of the cylindrical receiving portion 12 has a stopper leg 18 as a stopper section that extends downward being bent at a right angle from the rear edge of the top plate 16 (see also FIGS. 5(B) and 5(C)). The stopper leg 18 is a section to prevent fitting problem of the second connector 40. If the second connector 40 is inserted into the first connector 10 when the second connector 40 is oriented upside down, an entering tongue 41A of the second connector 40 touches the stopper leg 18, and thereby prevents entry of the entering tongue 41A therein. Moreover, although the stopper leg 18 is bent downward, the stopper leg 18 is relatively short and has some rigidity, so that it is achievable to securely prevent the above-described fitting problem of the second connector 40.

Furthermore, as shown in FIGS. 5(B) and 5(C), a lower end of the stopper leg 18 is provided lower than a rear end (free end) of the elastic contact piece 17. Therefore, a front end of the second connector 40 will not contact with the rear end of the elastic contact piece 17 from a rear side. Accordingly, it is possible to prevent damage of the elastic contact piece 17, such as bending, by the stopper leg 18.

Moreover, when the entering tongue 41A of the second connector 40 is inserted in the cylindrical receiving portion 12 of the first connector 10 while being slightly tilted upward, an upper surface (inclined surface) of the entering tongue 41A touches a lower end of the stopper leg 18, and then will be guided downward under the stopper leg 18. As a result, while the second connector 40 is brought back to the normal position (position so as to be parallel to a mounting surface of the circuit board P) from the tilted position, the second connector 40 can smoothly move forward to enter inside of the cylindrical receiving portion 12. Accordingly, the stopper leg 18 can also perform as a guiding section to the cylindrical receiving portion 12.

Furthermore, at a rear edge of the top plate 16, abutting sections 16A are formed near the both ends in the connector width direction so as to position the second connector 40 in the front-and-back direction. As will be described later, the abutting sections 16A are to be touched by positioning sections 44B provided in the second connector 40 from the backside thereof. Accordingly, the receiving depth to receive the second connector 40 by the cylindrical receiving portion 12 is set as specified and thereby the second connector 40 is positioned therein.

In the rear region II, which is a region behind the cylindrical receiving portion, there is formed open receiving portion 13, which is formed by the bottom plates 14 and the side plates 15. This open receiving portion 13 works as a section to receive and introduce the second connector 40 upon start of the receiving. In a state that the connectors 10 and 40 are fitted and connected upon completion of the receiving, the second connector 40 is accommodated in the whole receiving portion 11 that is composed of the open receiving portion 13 and the cylindrical receiving portion 12.

In the range of the rear region II, there are provided the edge plates 19 that are bent inward in the connector width direction from upper ends of the side plates 15, while extending in the front-and-back direction. In addition, in the middle part of the edge plates 19, there are provided locking pieces 20 that are formed being bent at a right angle towards the bottom plate 14 from inner edges (edges extending in the front-and-back direction) of the edge plates 19. In other words, the locking pieces 20 are indirectly joined to upper edges of the respective corresponding side plates 15 via the edge plates 19, and those two locking pieces 20 makes a pair facing each other in the connector width direction. Since those locking pieces 20 are provided within the open receiving portion 13, the presence of the locking pieces 20 will not increase the dimension of the first connector 10 in a height direction.

In the edge plates 19, lower surfaces thereof located on a front side relative to the locking pieces 20 are formed as first upper restricting sections 19A. In the state that the connectors 10 and 40 are fitted and connected, the first upper restricting sections 19A are located above first upper sections to be restricted 46C-2, which will be described later, and restrict upward elastic displacement of an elastic locked portion 43 (see FIG. 3).

In addition, parts of lower surfaces of the edge plates 19, which are at the same positions as where the locking pieces 20 are provided in the front-and-back direction, are formed as second upper restricting sections 19B. In a state that the connectors 10 and 40 are fitted and connected to each other, the second upper restricting sections 19B are brought above the second upper sections to be restricted 44C of the side wall sections 44 of the second connector 40, and restrict upward elastic displacement of the second connector 40 (see FIG. 3). Here, the second upper sections to be restricted 44C of the side wall sections 44 of the second connector 40 will be described later.

Each locking piece 20 has a generally quadrilateral shape when viewed in the connector width direction. Each locking piece 20 includes a locking portion 21. A front edge surface of each locking portion 21, which extends in the up-and down direction, is sloped backward to be upward. A rear edge surface of each locking portion 21, which extends in the up-and-down direction, has a curved shape, e.g., an arc shape, at a lower part thereof. These rear edge surfaces form inclined guide surfaces 22 that guide the elastic tongue to be locked 43, which will be described later (see FIGS. 5(B) and 5(C)).

The second connector 40 that is configured as described above and to be fitted and connected to the first connector 10 includes a flat section 41, the elastic tongue to be locked 43, the side wall sections 44, and a wire-connecting section 45. The flat section 41 spreads in the connector width direction and extends in the front-and-back direction in the connectors' fitted and connected state. The elastic tongue to be locked 43 extends backward from the front edge of the flat section 41 via bent sections 42. The side wall sections 44 rise from both side edges of the flat section 41. The wire-connecting section 45 is to be connected to the cable C behind the flat section 41.

As well shown in FIGS. 3 and 4, the flat section 41 includes the entering tongue 41A at its front part, which protrudes forward at a center of the flat section 41 in the connector width direction. An upper surface of the entering tongue 41A is an inclined surface such that a sheet thickness thereof is smaller towards the front end. Behind the entering tongue 41A, the upper surface of the flat section 41 is formed flat. As will be described later, the contacted portion 41B is configured to contact the elastic contact section 17A at its flat upper surface with certain contact pressure.

The elastic tongue to be locked 43 includes a pair of elastic locking arms 46 and a joining section 47. The pair of locking arms 46 extends backward from a front edge of the flat section 41 via the bent sections 42, and is elastically flexible so as to be displaceable in the up-and-down direction. Each bent section 42 has a U-shape that is 90-degree rotated counterclockwise such that the elastic tongue to be locked 43 will be lifted at the both ends in the connector width direction (both sides of the entering tongue 41A). The joining section 47 extends in the connector width direction and joins rear ends of the both elastic locking arms 46, which are free ends thereof. Therefore, with the pair of elastic locking arms 46 and the joining section 47, the elastic part 43 has a U-shape when viewed from thereabove.

Providing the two elastic locking arms 46 in this manner, it is possible to reduce the width of each elastic arm 46 and thereby the elastic locking arms 46 can easily elastically displace. In addition, joining the elastic locking arms 46 with the joining section 47, it is achievable to improve the strength. The bent sections 42 are configured such that a distance between outer side surfaces of the bent sections 42, which are at both sides in the connector width direction, is set slightly smaller than a distance between inner surfaces of the side plates 15 that are on both sides in the connector width direction.

Each elastic locking arm 46 has a slanted section 46A, a horizontal section 46B, and a projecting section 46C. The bias section 46A extends so as to reduce the distance between the elastic locking arms 46 in the middle part from the bent section 42 towards the rear side. Being continued from the bias sections 46A, the horizontal sections 46B extends backward while keep being horizontal to each other. The projecting sections 46C projects outward in the connector width direction from rear ends of the horizontal sections 46B. Moreover, the horizontal sections 46B have slope surfaces 46B-1, which go up towards the rear side at their middle parts.

A pair of the elastic locking arms 46 is configured so as to be brought to be at different positions in the connector width direction from the elastic contact piece 17 and the stopper leg 18 of the first connector 10. More specifically, when the elastic locking arms 46 are inserted in the cylindrical receiving portion 12 of the first connector 10, the pair of elastic locking arms 46 is brought to the both sides of the elastic contact piece 17 and the stopper leg 18 (see FIGS. 6(A) and 7).

Moreover, the pair of elastic locking arms 46 is also configured so as to have overlapping areas with the elastic contact piece 17 and the stopper leg 18 in the up-and-down direction (see FIGS. 6(B) and 6(C)). Therefore, according to the embodiment, providing the elastic locking arms 46 at different positions in the connector width direction from the elastic contact piece 17 and the stopper leg 18, without interfering with the elastic leg 17 and the stopper leg 18, the pair of elastic locking arms 46 can have overlapping areas with the elastic leg 17 and the stopper leg 18 in the up-and-down direction. As a result, it is achievable to reduce the height dimension of the connector assembled component 1 for a dimension equivalent to the overlapping area and thereby to miniaturize the connector assembled component 1 in the height direction.

In rear ends of horizontal sections 46B, i.e., parts of the rear ends of the elastic locking arms 46 that are located at inner side than the projecting sections 46C in the connector width direction form sections to be locked 46B-2. The sections to be locked 46B-2 engage with the locking portions 21 of the first connector 10. In addition, the projecting sections 46C are located in recesses formed at the respective side wall sections 44. A lower surface of each recess 46C forms a lower restricting section 46C-1 (see FIG. 3), which will be described later. When lower sections to be restricted 46C-1 are provided above the lower restricting sections 44A-1 formed in the recesses 44A of the side wall sections 44, downward elastic displacement of the elastic locking arms 46 is kept within certain amount. Moreover, upper surfaces of the projecting sections 46C form first upper sections to be restricted 46C-2. When the connectors 40 and 10 are fitted and connected to each other, the first upper sections to be restricted 46C-2 are brought under the first upper restricting sections 19A of the first connector 10, and thereby upward elastic displacement of the elastic locking arms 46 is restricted.

The joining section 47 extends in the connector width direction so as to join inner edges of the rear ends of the horizontal sections 46B. The joining section 47 has a lock-releasing section 47A, which protrudes backward from a center part of a rear edge of the joining section 47 in the connector width direction. The lock-releasing section 47A is a part that receives pressing force from thereabove to release the engagement between the connectors 40 and 10 when one connector is pulled from the other. The lock-releasing section 47A protrudes backward and has a large area, so as to enable easy lock release. Moreover, the lock-releasing section 47A is to be brought between the locking pieces 20 of the first connector 10 in the connectors' fitted and connected state, so that it is possible to avoid interference with the locking pieces 20 (see FIGS. 6(A) and 7).

A flat surface of the horizontal section 46B of each elastic locking arm 46 is horizontal to the upper surface of the flat section 41. On the other hand, a flat surface of each locking piece 20 that forms the locking piece 20 of the first connector 10 is perpendicular to the bottom plate 14 of the first connector 10. Therefore, the sections to be locked 46B-2 of the horizontal sections 46B and the locking portions 21 of the first connector 10 are perpendicular to each other when viewed in the front-and-back direction. In this perpendicular physical relationship, if the second connector 40 is pulled backward in the connectors' fitted and connected state, the sections to be locked 46B-2 touch the locking portions 21 of the first connector 10 and are locked therein. Therefore, the second connector 40 is securely prevented from coming off from the first connector 10.

Furthermore, according to the embodiment, the locking portions 21 and the sections to be locked 46B-2 abut each other to lock, so that the strength against the abutting force is high. Moreover, the sections to be locked 46B-2 of the second connector 40 are formed at rear edges of the horizontal sections 46B, which are horizontal to the upper surfaces of the flat sections 41. Therefore, the presence of the sections to be locked 46B-2 will not increase the dimension of the second connector 40.

The side wall sections 44 are formed rising from the both side edges of the flat section 41, so as to extend from right behind the bent sections 42 to crimping sections 45A in the front-and-back direction. According to the embodiment, a distance between outer surfaces of the side wall sections 44 is almost the same as a distance between outer end surfaces of the bent sections 42 provided in front of the side wall sections 44. Therefore, upon fitting to connect the connectors 10 and 40, once the cylindrical receiving portion 12 in the front region I of the first connector 10 receives the bent sections 42, the side wall sections 44 are received in the open receiving portion 13 between the side plates 15 in the rear region II of the first connector 10.

On the side wall sections 44, there are formed the recesses 44A that are recessed in the height direction in the middle of the side wall sections 44 in the front-and-back direction. A lower edge of each recess 44A forms a lower restricting section 44A-1, which can touch a lower surface of the projecting section 46C located in the recess 44A, i.e., the lower section to be restricted 46C-1. The lower restricting sections 44A-1 can touch the lower sections to be restricted 46C-1, upon downward elastic displacement of the lower sections to be restricted 46C-1. Accordingly, the lower restricting sections 44A-1 stops excessive elastic displacement of the lower sections to be restricted 46C-1, and thereby it is achievable to prevent generation of excess stress on the elastic locking arms 46. Moreover, each side wall section 44 has a step-like section that is formed by cutting out an upper part of the front end-side portion thereof. Among surfaces that compose the step-like section, a surface perpendicular to the front-and-back direction is formed as a positioning section 44B that can abut the contacting section 16A of the first connector 10 from behind.

In addition, an upper-end surface of each side wall section 44, which is located behind the recess section 44A, forms a second upper section to be restricted 44C. In a state that the connectors 10 and 40 are fitted and connected, the second upper sections to be restricted 44C are brought to under the second upper restricting sections 19B of the first connector 10, and thereby it is achievable to restrict upward displacement of the second connector 40.

According to the embodiment, the wire-connecting section 45 provided behind the side wall sections 44 has the crimping arms 45A and clamping arms 45B. The crimping arms 45A are pressed so as to crimp and connect a core wire of the cable C, and the clamping arms 45B are pressed so as to clamp the coating of the cable C behind the crimping arms 45A. According to the embodiment, an example, in which the second connector 40 has the wire-connecting section 45, is shown, but an embodiment of the second connector 40 of the present invention is not limited to the one having the wire-connecting section 45. Alternatively, the second connector 40 can be a connector that connects to a connecting member other than a cable, such as a circuit board, via other means.

Figure 5:
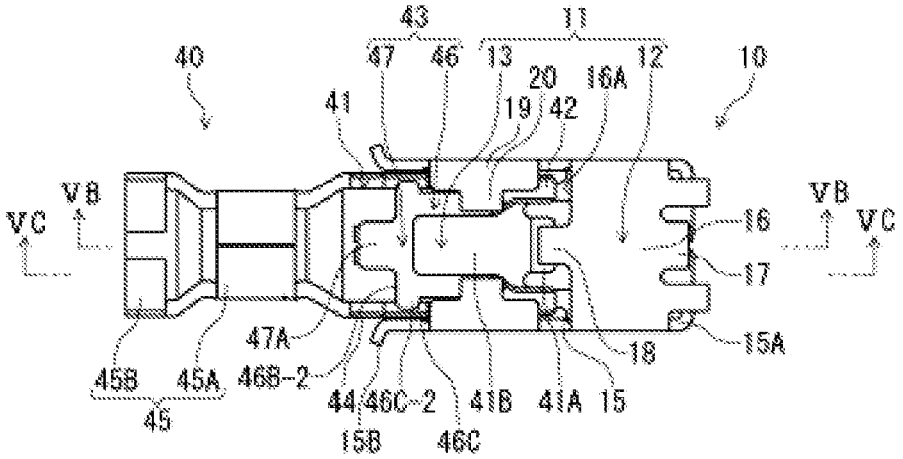
Figure 5:
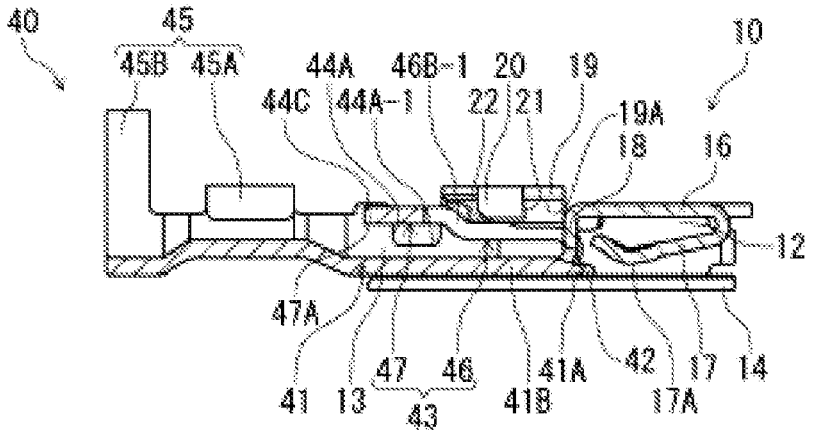
Figure 5:
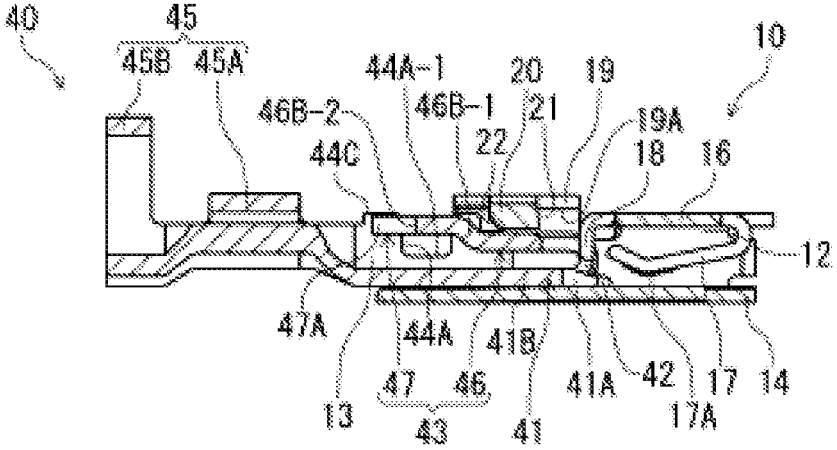
Figure 6:
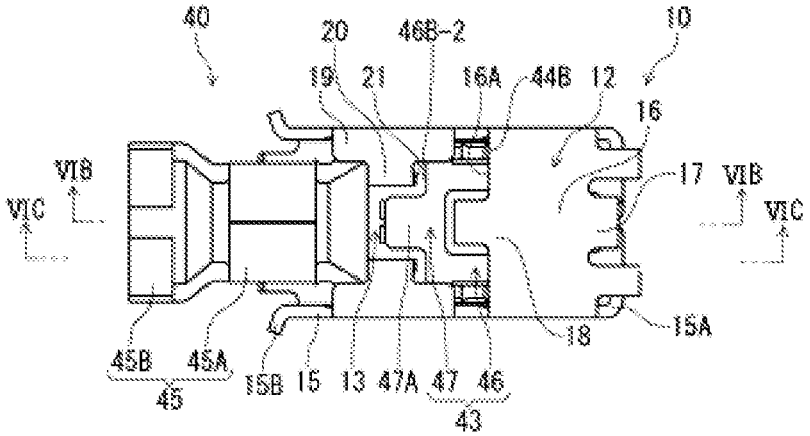
Figure 6:
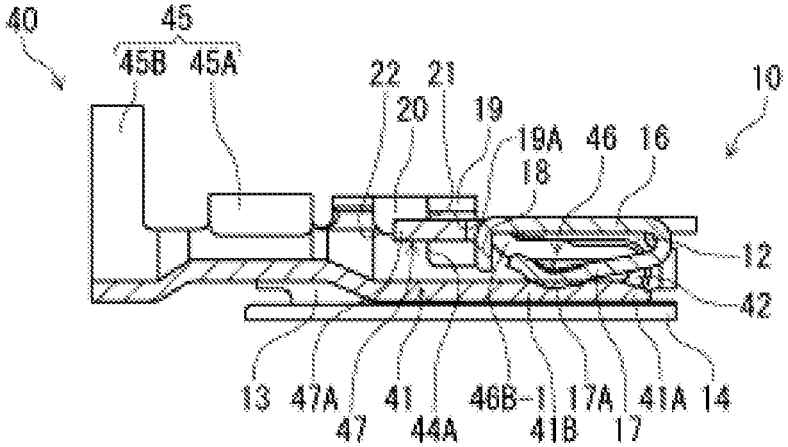
Figure 6:
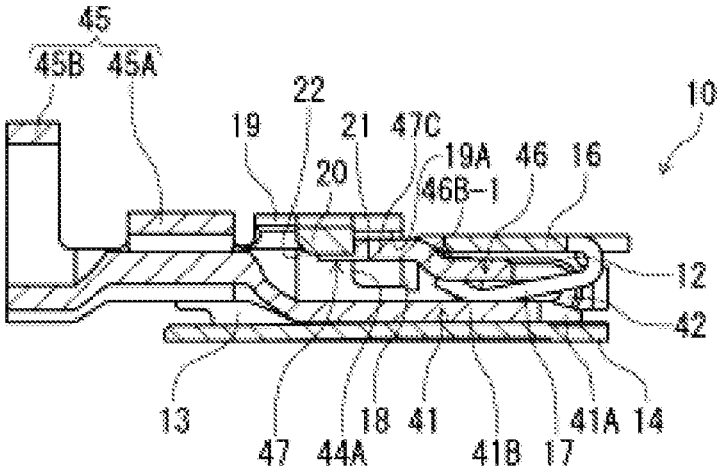
Figure 7:
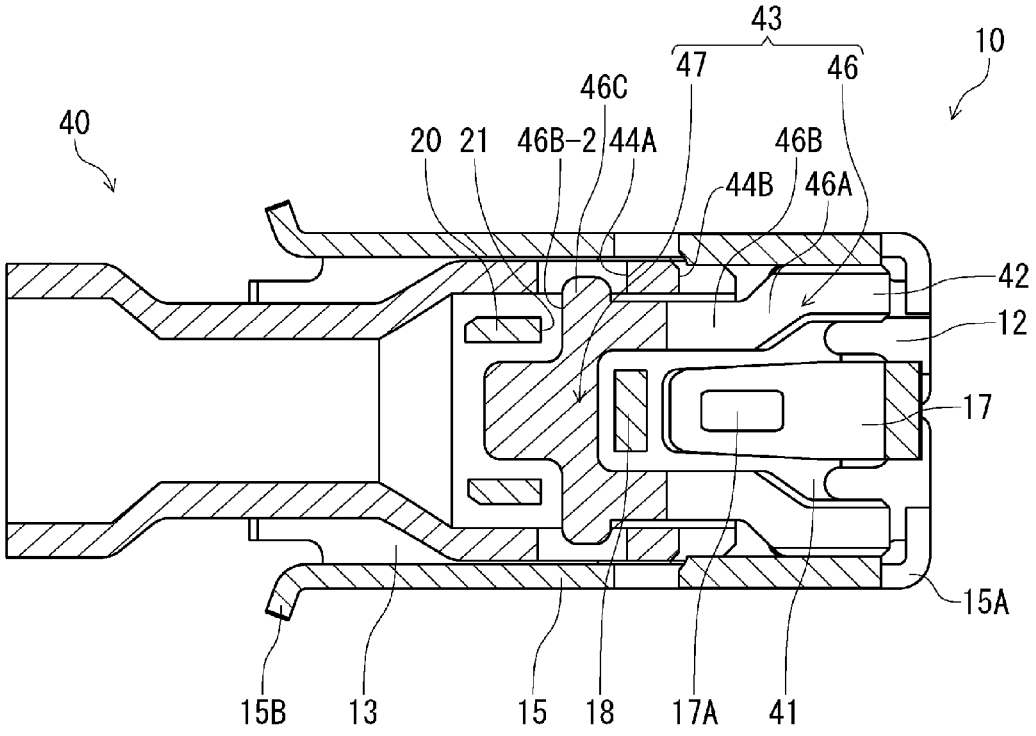
FIG. 7 is a sectional view of the electrical connector assembled component of FIG. 2, taken along a surface perpendicular to an up-and-down direction, i.e., a sectional top view of FIG. 2 taken along a surface horizontally right under a top plate of the first connector according to the embodiment of the present invention.

Next, referring to FIGS. 1 and 5 through 7, procedure of fitting and connecting the connectors 10 and 40 for the connector assembled component 1 according to the embodiment will be described. Here, FIG. 6(A) is a top view showing the connector assembled component 1 after fitting and connecting the connectors 10 and 40. FIG. 6(B) is a sectional view of FIG. 6(A), taken at a line VIB-VIB. FIG. 6(C) is a sectional view of FIG. 6(A), taken at a line VIC-VIC. Moreover, FIG. 7 is a sectional view of the connector assembled component 1 of FIG. 2, taken at a surface perpendicular to the up-and-down direction of FIG. 2, which is right under the top plate 16 of the first connector 10, when viewed from thereabove. Here, in FIGS. 5 through 7, illustration of the circuit board P and the cable C is omitted.

First, as shown in FIG. 1, the first connector 10 is mounted on a mounting surface of the circuit board P, and the second connector 40 is connected to the cable C. Then, as shown in FIG. 1, behind the first connector 10, the second connector 40 is positioned while having the cable C extends in the front-and-back direction. Thereafter, moving the second connector 40 forward, insertion of the first connector 10 in the receiving portion 11 is started.

Upon insertion of the second connector 40, even if the second connector 40 is slightly displaced in the connector width direction from the receiving portion 11 of the first connector 10, the introductory guide section 15B of the first connector 10 guides the second connector 40 in the connector width direction into the open receiving portion 13 of the receiving portion 11. FIGS. 5(A) through 5(C) show a state that the insertion of the second connector 40 progressed and the front end of the second connector 40 reaches the rear end of the cylindrical receiving portion 12 of the first connector 10. Here, FIG. 5(A) is a top view of the connector assembled component 1, FIG. 5(B) is a sectional view of FIG. 5(A), taken at a line VB-VB, and FIG. 5(C) is a sectional view of FIG. 5(A), taken at a line VC-VC.

As shown in FIG. 5(A), in the insertion process of the second connector 40, inner surfaces of the side plates 15 of the first connector 10 restrict movement of the side wall sections 44 of the second connector 40 in the connector width direction. Moreover, as shown in FIGS. 5(A) through 5(C), the side wall sections 44 of the second connector 40 are configured to move right under the edge plates 19 of the first connector 10. The edge plates 19 restrict the upward movement of the second connector 40. Therefore, with the restrictions on the movement of the second connector 40 in the connector width direction and in the up-and-down direction, it is achievable to securely guide the second connector 40 into the cylindrical receiving portion 12.

Once the insertion of the second connector 40 progresses, the slope surfaces 46B-1 of the elastic locking arms 46 of the second connector 40 contact the inclined guide surfaces 22 of the locking pieces 20 of the first connector 10, and receive reaction force from the inclined guide surfaces 22. As a result, the elastic locking arms 46 are gradually elastically displaced downward, whereby further forward movement of the second connector 40 is allowed to further progress the insertion. Then, portions behind the slope surfaces 46B-1 of the elastic locking arms 46 are pressed by lower surfaces (flat side surfaces) of the locking pieces 20. While keeping the state where the elastic locking arms 46 are elastically displaced to a maximum extent, the insertion of the second connector 40 is continued.

Further inserting the second connector 40 forward towards inside of the cylindrical receiving portion 12 of the first connector 10, the pair of the elastic locking arms 46 of the second connector 40 pass both sides of the stopper leg 18 provided at the cylindrical receiving portion 12, then pass both sides of the elastic contact piece 17 so as to move forward. In short, the stopper leg 18 and the elastic contact piece 17, which are provided at the cylindrical receiving portion 12, enter from a front side of the second connector 40 to between the elastic locking arms 46.

On the other hand, after the entering tongue 41A of the flat section 41 passes under the stopper leg 18, the flat section 41 of the second connector 40 abuts the elastic contact section 17A of the elastic contact piece 17 so as to press the elastic contact piece 17 upward and elastically displace the elastic contact piece 17 upward. Then, even after completion of the connector insertion, the elastically displaced state of the elastic contact piece 17 is maintained, and the elastic contact section 17A contacts with the contacted portion 41B of the flat section 41 from thereabove with certain contact pressure. As a result, the connectors 10 and 40 are electrically connected. In FIG. 6(B), which shows the connectors' fitted and connected state, the elastic contact piece 17 is not shown in the elastically displaced state. The elastic contact section 17A is overlapped with the contacted portion 41B. However, the elastic contact piece 17 is elastically displaced upward for the amount of the overlapped dimension in the up-and-down direction.

Furthermore, the second connector 40 is moved forward towards inside of the cylindrical receiving portion 12 and the rear ends of the elastic locking arms 46 of the second connector 40 reach the positions in front of the locking pieces 20 of the first connector 10. Then, as well shown in FIG. 6(B) and 6(C), the elastic locking arms 46 are released from the elastically displaced state and returned to the free state. Generally at the same time, as well shown in FIG. 6(A), the positioning sections 44B of the side wall sections 44 of the second connector 40 abut the contact section 16A formed on the rear edge of the cylindrical receiving portion 12 of the first connector 10, whereby further frontward movement of the second connector 40 is restricted. As a result, the electrically connected state and the locked state of the connectors 10 and 40 are maintained, and the process of fitting and connecting the connectors 10 and 40 is completed.

If the second connector 40 is inserted in the first connector 10, while the second connector 40 is oriented upside down, the entering tongue 41A of the second connector 40 abuts the stopper leg 18 of the first connector 10 from behind. Therefore, further frontward movement of the second connector 40 is inhibited. Accordingly, it is achievable to securely prevent wrong fitting of the second connector 40.

According to the embodiment, the front part of the second connector 40 is inserted in the cylindrical receiving portion 12 of the first connector 10. Therefore, a front end of the second connector 40 is covered by the cylindrical receiving portion 12, and it is impossible to visually check depth of the insertion. However, the positioning section 44B of the second connector 40 abuts the contact section 16A of the first connector 10, so that the second connector 40 will not be excessively inserted and an insertion end point is set by itself. In addition, with this abutting, it is possible to feel whether the second connector 40 is inserted to the position.

Furthermore, when the second connector 40 reaches the set position, the elastic locking arms 46 move upward to return to the free state. As its rebound, the first upper sections to be restricted 46C-2 (upper surfaces) of the projecting sections 46C of the elastic locking arms 46 touch the first upper restricting sections 19A of the first connector 10 from thereabove and produce clicking feeling. Therefore, with this clicking feeling, it is also possible to recognize the second connector 40 is inserted to the set position.

In the connectors' fitted and connected state, as shown in FIGS. 6(C) and 7, the sections to be locked 46B-2 formed on rear edges of the elastic locking arms 46 face the locking portions 21 (front end surfaces) of the locking pieces 20 in front of the locking pieces 20. Therefore, in the connectors' fitted and connected state, even if the second connector 40 is pulled backward, the sections to be locked 46B-2 engage with the locking portions 21 and stop the backward movement of the second connector 40, so that it is achievable to securely prevent unexpected coming off of the second connector 40.

Furthermore, according to the embodiment, the locking portions 21 are sloped backward to be upward. Therefore, when the sections to be locked 46B-2 are in the state of abutting to engage with the locking portions 21 (in the locked state), the sections to be locked 46B-2 displace upward along the slope of the locking portions 21, i.e., in a direction towards the bent basal sections of the locking portions 21. As a result, the sections to be locked 46B-2 move away from the free ends (lower ends of the locking pieces 20), in which the locking can easily be released, so that the locking can be deeper and will not be easily released. According to the embodiment, the locking portions 21 are configured to be sloped backward towards an upper side. However, when it is possible to secure enough locking depth, it is also possible not to have the locking portions be sloped. For example, the locking portions can be formed to have flat side surfaces that are perpendicular to the front-and-back direction.

In the connectors' fitted and connected state, as shown in FIGS. 6(A) through 6(C), the first upper sections to be restricted 46C-2 of the second connector 40 are located right under the first upper restricting sections 19A of the first connector 10. Therefore, in the connectors' fitted and connected state, even when upward external force is unexpectedly applied on the elastic locking arms 46 of the second connector 40, the first upper sections to be restricted 46C-2 abut the first upper restricting sections 19A from thereunder, and thereby the upward displacement of the elastic locking arms 46 is restricted. Therefore, it is possible to prevent damage of the elastic locking arms 46.

Moreover, in the connectors' fitted and connected state, as shown in FIGS. 6(A) through 6(C), the second upper sections to be restricted 44C of the second connector 40 are brought right under the second upper restricting sections 19B (see FIG. 3) of the first connector 10. Therefore, in the connectors' fitted and connected state, when the cable C or the second connector 40 is unexpectedly lifted, the second upper sections to be restricted 44C abut the second upper restricting sections 19B from thereunder to engage thereto. As a result, the upward movement of the second connector 40 is inhibited and it is achievable to securely keep the connectors' fitted and connected state.

Upon pulling out the second connector 40 from the first connector 10, which are in the connectors' fitted and connected state, an upper surface of the lock-releasing section 47A of the second connector 40 is pressed down with a jig (not illustrated) or a finger, so as to elastically displace the elastic locking arms 46 downward. Accordingly, the rear ends of the elastic locking arms 46 are brought under the locking pieces 20 of the first connector 10. As a result, the state (locked state) where the sections to be locked 46B-2 formed at the rear ends of the elastic locking arms 46 can engage with the locking portions 21 formed at the front edges of the locking pieces 20 is released. Then, while keeping the elastically displaced state of the elastic locking arms 46, pull the second connector 40 backward so as to let the elastic locking arms 46 pass under the locking pieces 20, so that it is possible to easily pull out the second connector 40.

According to the embodiment, the elastic contact piece 17 of the first connector 10 is positioned between the pair of the elastic locking arms 46 of the second connector 40 in the connector width direction. However, the physical relation between the elastic contact piece 17 and the elastic locking arms 46 in the connector width direction is not limited to this. Alternatively, the elastic contact piece 17 and the elastic locking arms 46 can be at any positions as long as they do not interfere with each other in the connector width direction upon fitting and connecting the connectors 10 and 40. For example, one each of the elastic contact piece of the first connector 10 and the elastic locking arm of the second connector 40 can be provided at positions that are opposite to each other so as not to have overlapped area in the connector width direction.

According to the embodiment, the elastic contact piece 17 of the first connector 10 extends backward from the front edge of the top plate 16 of the cylindrical receiving portion 12 in the cylindrical receiving portion 12. However, the embodiment of the elastic contact piece is not limited to this. For example, the elastic contact piece can be provided so as to extend backward from the front edge of the bottom plate or forward from the rear edge of the top plate. In addition, when the elastic contact piece is provided extending from the bottom plate, for example, the elastic contact section of the elastic contact piece may be formed so as to protrude upward, and elastically contact with a lower surface of the contacted portion of the second connector.

The disclosure of Japanese Patent Applications No. 2014-085477, filed on Apr. 17, 2014, is incorporated in the application by reference.

While the present invention has been explained with reference to the specific embodiments of the present invention, the explanation is illustrative and the present invention is limited only by the appended claims.

What is claimed is:

1. An electrical connector assembled component, comprising:

a first connector to be disposed on a circuit board and including a receiving portion; and a second connector to be accommodated in the receiving portion, wherein said first connector is formed of a metal plate curved in a specific shape, said receiving portion includes a cylindrical receiving portion and an open receiving portion, said cylindrical receiving portion includes a bottom plate portion to be contacted with the electrical board, a side plate portion extending from the bottom plate portion, and an upper plate portion connecting the side plate portion, said open receiving portion includes the bottom plate portion and the side plate portion to open upwardly, said open receiving portion includes a locking piece connected to the side plate portion, said locking piece includes a locking portion at a front edge thereof, said cylindrical receiving portion further includes an elastic contact piece, said second connector is formed of a metal plate curved in a specific shape, said second connector includes a flat plate portion extending in a width direction, said second connector further includes a contacted portion disposed on the flat plate portion for contacting with the elastic contact piece, said second connector further includes an elastic locking arm extending from the flat plate portion, said elastic locking arm includes a locked portion for engaging with the locking portion, and said elastic locking arm is situated inside the cylindrical receiving portion at a position different from that of the elastic contact piece in the width direction, and at a position overlapped with that of the elastic contact piece in a vertical direction.

2. The electrical connector assembled component according to claim 1, wherein said locking portion is arranged so that a plate surface thereof crosses that of the locked portion when the locking portion engages with the locked portion.

3. The electrical connector assembled component according to claim 1, wherein said locking piece includes a pair of locking pieces facing each other in the width direction and being curved toward the bottom plate portion, and said locking portion is disposed at the front edge of each of the locking pieces.

4. The electrical connector assembled component according to claim 1, wherein said locking piece includes a guiding included surface for pushing the elastic locking arm to elastically deform when the second connector is inserted into the receiving portion so that the second connector can move farther.

5. The electrical connector assembled component according to claim 1, wherein said locking piece is arranged to be inclined to generate an upward force so that the locked portion is deformed upwardly when the locking piece engages with the locked portion.

6. The electrical connector assembled component according to claim 1, wherein said second connector further includes a positioning portion for abutting against the cylindrical receiving portion so that the second connector is inserted into the cylindrical receiving portion up to a specific depth.

7. The electrical connector assembled component according to claim 1, wherein said second connector further includes a lower restricting portion for restricting a downward elastic deformation of the elastic locking arm.

8. The electrical connector assembled component according to claim 1, wherein said second connector further includes an upper restricting portion for restricting an upward elastic deformation of the elastic locking arm.

9. The electrical connector assembled component according to claim 1, wherein said second connector is formed in an asymmetry shape in a vertical direction, and said first connector further includes a stopper portion for stopping the second connector when the second connector is inserted into the receiving portion in a wrong way in the vertical direction.

10. The electrical connector assembled component according to claim 1, wherein said first connector further includes a stopper portion for stopping the second connector when the second connector is inserted into the receiving portion in a wrong way in the vertical direction, said stopper portion is disposed on the upper plate portion to extend downwardly, and said stopper portion includes a lower edge situated at a position below the elastic contact piece.

11. The electrical connector assembled component according to claim 1, wherein said elastic locking arm includes a pair of elastic locking arms arranged away from each other in the width direction, said pair of elastic locking arms is connected at end portions thereof so that the elastic contact piece is inserted between the pair of elastic locking arms.

* * * * *